US005860540A

United States Patent [19]

Bock

[11] Patent Number: 5,860,540

[45] Date of Patent: Jan. 19, 1999

[54] TEAT UNIT AND A DISPOSABLE PACKAGE AS WELL AS A METHOD OF MAKING THE TEAT UNIT

[75] Inventor: Steen Bock, Solrød Strand, Denmark

[73] Assignee: Baby Pack Holding ApS, KogeState, Denmark

[21] Appl. No.: 619,480

[22] PCT Filed: Sep. 17, 1993

[86] PCT No.: PCT/DK93/00298

§ 371 Date: Apr. 19, 1996

§ 102(e) Date: Apr. 19, 1996

[87] PCT Pub. No.: WO95/07680

PCT Pub. Date: Mar. 23, 1995

[51] Int. Cl.[6] ..... A61J 9/02; A61J 11/00; A61J 11/04

[52] U.S. Cl. ..... 215/11.2; 215/11.1; 220/278

[58] Field of Search ..... 215/11.1, 11.2, 215/11.3; 220/278

[56] References Cited

U.S. PATENT DOCUMENTS

| | | | |
|---|---|---|---|
| 3,253,753 | 5/1966 | Barton et al. | 215/11.1 X |
| 3,266,910 | 8/1966 | Barnby et al. | 215/11.1 X |
| 3,796,337 | 3/1974 | Seunevel . | |
| 3,838,784 | 10/1974 | Barton et al. | 215/11.1 |
| 4,801,007 | 1/1989 | Rule | 215/11.3 X |
| 4,830,205 | 5/1989 | Hammond et al. | 215/11.3 |
| 4,867,324 | 9/1989 | Rogosich et al. | 215/11.1 |
| 4,919,983 | 4/1990 | Fremin | 215/11.2 X |
| 4,946,040 | 8/1990 | Ipenburg | 215/11.3 X |

FOREIGN PATENT DOCUMENTS

| | | | |
|---|---|---|---|
| 2653749 | 5/1991 | France . | |
| 3836424 | 7/1989 | Germany | 215/11.2 |
| 1313056 | 12/1989 | Japan | 215/11.1 |
| 8504571 | 10/1985 | WIPO | 215/11.1 |

*Primary Examiner*—Sue A. Weaver
*Attorney, Agent, or Firm*—Darby & Darby

[57] ABSTRACT

A teat unit for use when dispensing directly into the mouth from a fluid-containing disposable package of a thin sheet-shaped plastic or cardboard material. The teat unit includes an upwardly extending teat part, an intermediate radial flange and a downwardly extending insertion part. The insertion part has structure for holding the teat unit in position during dispensing with the radial flange having a downwardly facing side in engagement with the top side of the package, and structure for puncturing the top side of the package through an exposed opening in the top side of the package. The radial flange is shaped as a cover plate having substantially the same extent as the area of the top side of the package for the package size with which the teat unit is to be used, and the holding structure is adapted to hold the cover plate to bear against the top side of the package and to hold the top side of the package in direct sealing engagement with the downwardly facing side of the cover plate.

6 Claims, 2 Drawing Sheets

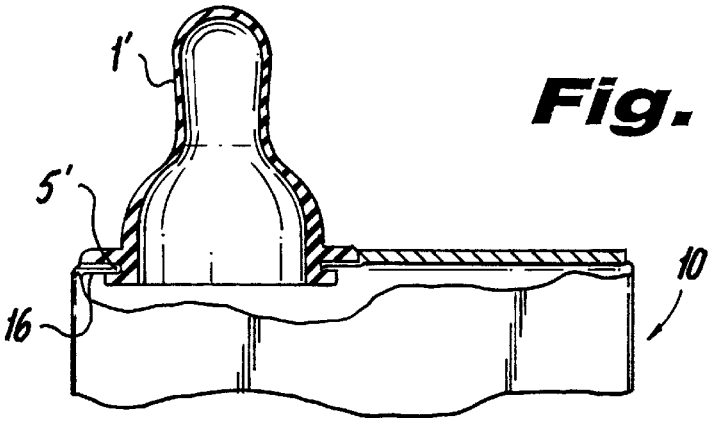
Fig. 5
Fig. 6
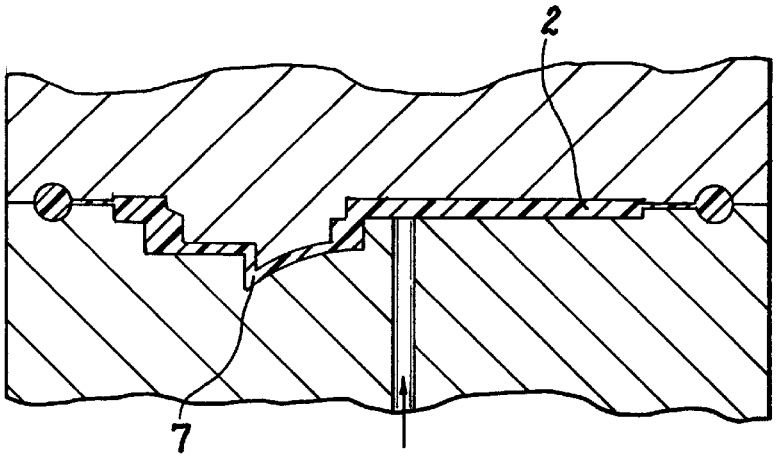
Fig. 7
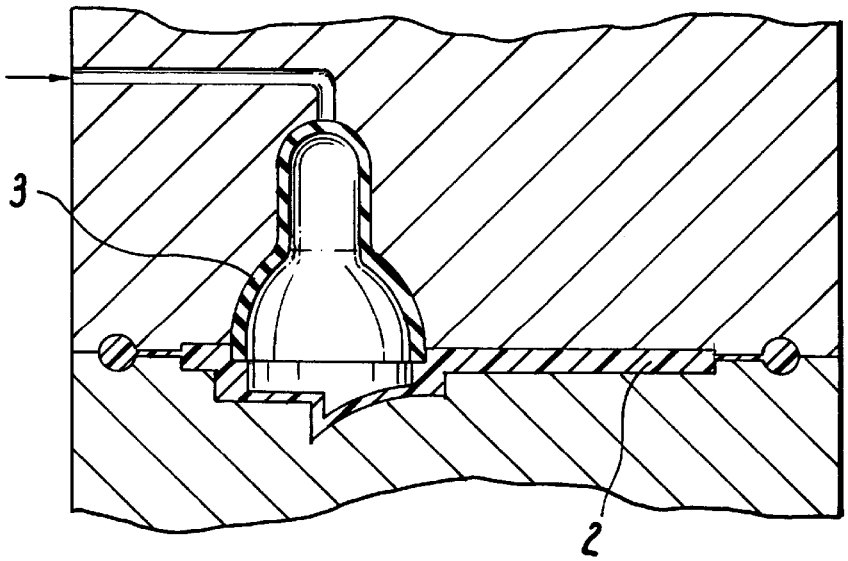

TEAT UNIT AND A DISPOSABLE PACKAGE AS WELL AS A METHOD OF MAKING THE TEAT UNIT

BACKGROUND

1. Field of the Invention

The present invention concerns a teat unit for use when dispensing directly into the mouth from a fluid-containing disposable package of thin sheet-shaped plastics or cardboard material, said teat unit comprising an upwardly extending teat part, an intermediate radial flange and a downwardly extending insertion part, which comprises holding means adapted to hold the teat unit in position during dispensing with the radial flange in external engagement with the container side after the insertion part has broken the package side and has been moved through an exposed opening in it.

2. Description of the Prior Art

DE Offenlegungsschrift 35 35 653 discloses a disposable package which contains a sterilely packaged milk container of powdered milk or liquid milk concentrate, which must be mixed with water before the contents can be consumed. The sealed opening must therefore be broken before the water can be added to the concentrated contents of the package, involving no small danger of the contents being contaminated by bacteria via the water. It is particularly important that the baby milk is so bacteria-free as at all possible when it is consumed by the baby. When heating the contents to the desired temperature, the old-fashioned method must be used, comprising applying a small drop of the milk to the back of the hand, or using a thermometer which is immersed in the milk involving a greatly increased risk of contaminating it with bacteria.

SUMMARY OF THE INVENTION

The object of the present invention is to provide both a teat unit and a disposable package which is particularly easy to use without having to consider the risk of contaminating the contents with bacteria.

The novelty of the invention is that the radial flange of the teat unit is shaped as a cover plate of substantially the same extent as the area of the said package side for the package size with which the teat unit concerned is used, and that the holding means are adapted to hold the opening rim in direct sealing engagement at the downwardly facing side of the cover plate. The advantages of this is that the baby's mouth and the dispensed fluid contents, such as the warm milk, do not contact the exterior side of the package, which may be contaminated with bacteria.

According to the invention the holding means may comprise external threads on the insertion part which terminate in an annular groove directly below the cover plate to receive the package material. This ensures a particularly good retention of the teat unit during dispensing.

Furthermore, according to the invention, the threads may expand conically in an upward direction toward the groove, so that the package material in the opening rim is pressed radially outwardly when the teat unit is screwed on, thereby providing a special seal and retention.

It should be mentioned that the annular groove ensures that it is difficult to screw the teat unit out of the opening again, since the teat unit merely rotates without the threads biting the opening rim, which contributes to providing safe retention during dispensing.

According to the invention, the cover plate may also comprise parts protruding beyond the package side of the associated package and even extending downwardly over the adjoining package sides with a downwardly extending, annular edge.

The invention provides a disposable package which exteriorly comprises a section having a temperature sensitive coating adapted to change its colour during heating. This entails that the fluid contents of the package, such as a milk supply, is so sterile and bacteria-free as at all possible before the milk is to be consumed. The milk supply can be heated in the unopened state of the package, said package being merely placed in a microwave oven or immersed in hot water, and when the temperature sensitive coating has changed to the correct colour it is certain that the desired temperature has been reached, and the sealed opening can be broken, the teat means can be placed in the opening, and the milk can be consumed by a baby.

The invention will be explained more fully below with reference to particularly preferred embodiments as well as the drawing, in which

BRIEF DESCRIPTION OF THE DRAWINGS

FIG. 5 is an enlarged sectional view of the top part of the disposable package, with the teat placed in position in the opening; and FIG. 6 is a sectional view of a cover plate after molding in an injection molding machine; and FIG. 7 is a sectional view of a cover plate and teat part after comolding in an injection molding machine.

Figure 1:
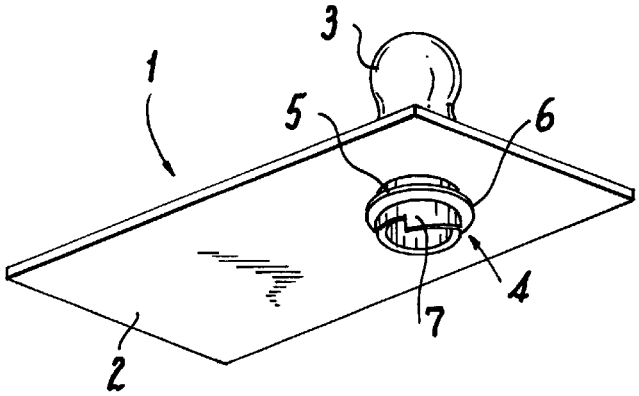
FIG. 1 is a perspective view of the teat unit.

The teat unit 1 shown in FIG. 1 comprises an upwardly extending teat part 3, an intermediate radial cover plate 2 and a downwardly extending insertion part 4. In the shown embodiment the cover plate 2 has the same extent as the area of the associated package side on which the teat unit 1 is to be placed for dispensing.

DETAILED DESCRIPTION OF THE PREFERRED EMBODIMENTS

The insertion part 4 comprises external threads 6 which expand conically in an upward direction toward an annular groove 5 which is provided directly below the downwardly facing side of the cover plate 2. The groove 5 preferably has a width which is smaller than the thickness of the package material in the opening rim 16 which is to be received in the groove 5.

Figure 2:
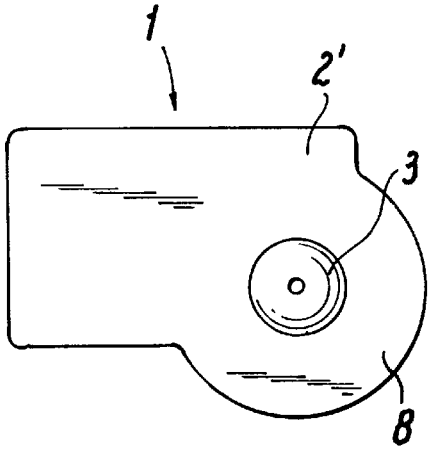
FIG. 2 is a top view of the same.

In the embodiment shown in FIG. 2 the teat unit 1 comprises a cover plate 2' provided with parts 8 which protrude beyond the extent of the area of the container side. The protruding part might also conceivably extend as an annular edge down along the adjoining package sides.

In the embodiments shown in FIGS. 1 and 2 the insertion part 4 is provided with a downwardly extending knife 7 for use when breaking optional sealing material in the opening 14.

When the teat unit shown in FIGS. 1 and 2 is screwed down into an exposed opening 14 in the disposable package, the conical course of the threads 6 entails that the material in rim 16 of opening 14 is expanded radially and compressed to provide particularly a good and safe retention in the annular groove 5. It will simultaneously be difficult to screw the teat unit 1 out of the opening again, because the material in the opening rim 16 merely rotates in the annular groove 5 without it being possible for the upper part of the threads 6 to bite. When the teat unit 1 is to be removed, it must simply be pulled directly out of the opening 14 with a greater force.

The embodiment of the teat unit shown in FIGS. 1 and 2 may be produced by producing the cover plate 2 and the insertion part 4 of the teat unit 1 from a stiff plastics material, such as polyethylene, as a unitary member by injection moulding, and the actual teat part may subsequently be injection moulded from a resilient rubber-like plastics material by direct injection into a tool in which the premade unit has been inserted beforehand as shown in FIGS. 6 and 7. This ensures an unprecedented good and safe retention between the teat part and the cover plate.

Figure 3:
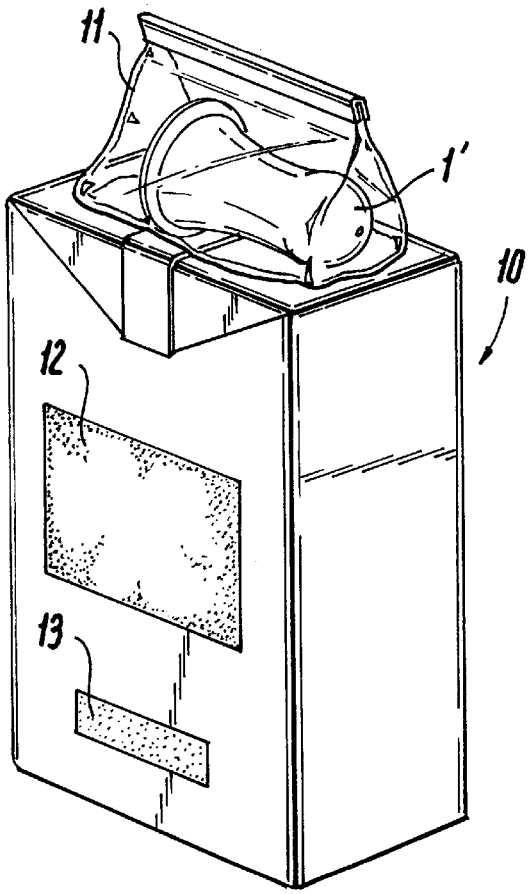
FIG. 3 is a perspective view of the disposable package in the closed state, having adhered to its top a teat unit according to a second embodiment, wrapped sterilely in plastics sheet.

In the embodiment of the teat unit 1' shown in FIGS. 3 and 5 the teat unit 1' is made in one piece by injection moulding from a resilient rubber-like material. In this embodiment the insertion part therefore just comprises the underlying annular groove 5' which is downwardly terminated by an annular bead or edge. For insertion, the resilient rubber-like material is merely compressed when the insertion part is passed down through the opening, and the material will then expand again to good retention of the opening rim 16 in the groove 5'.

Figure 4:
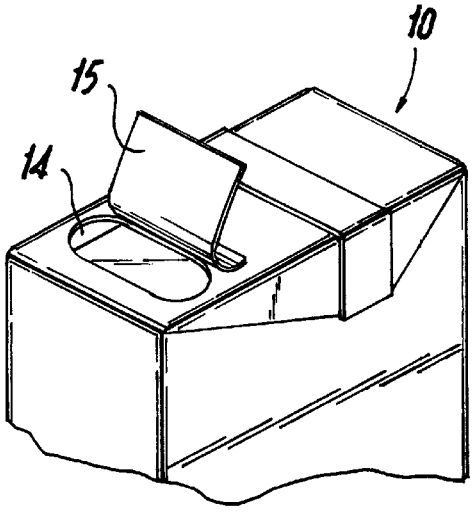
FIG. 4 is a view of the top part of the disposable package with the opening exposed.

The disposable package 10 shown in FIGS. 3, 4 and 5 is made by known methods from web-shaped cardboard material provided with a liquid-tight coating, such as a plastics film, which is provided with decoration, e.g. in the form of a company logo 12, already prior to the folding to the finished package. According to the present invention the web material is simultaneously provided with sections, with a temperature sensitive coating 13 which is adapted to change its colour at specific temperatures during heating. Further, round holes 14 are punched in the web material, which are sealed by means of a tear-off sheet 15.

Then the web material is folded and glued to provide the disposable package 10, and before the top is closed, the fluid supply, e.g. in the form of milk, is poured into the package in sterile surroundings.

A teat 1' wrapped sterilely in plastics sheet 11 may be glued on top of the package 10.

The teat 1' is removed from the disposable package 10, which is placed in a microwave oven or immersed in hot water to heat the milk supply. When the section having the temperature sensitive coating 13 has changed to the desired colour, e.g. from a blue to a green colour, the desired temperature of about 37°–40° C. of the milk supply has been reached.

As shown in FIG. 4, the opening can now be broken by tearing off the tear-off sheet 15, and the teat 1' may be placed in the opening, as shown in FIG. 5. The baby can then consume the milk supply, it being completely certain that the milk supply is constantly kept in a sterile environment and has not been contaminated undesirably by bacteria which may be very harmful to the baby. It is moreover certain that the milk has reached the desired and correct temperature by the heating before the package is broken. Further, it is certain that the baby's mouth will not contact the exterior side of the package, which may contain bacteria.

I claim:

1. A teat unit for use when dispensing directly into the mouth from a fluid-containing disposable package of a thin sheet-shaped plastic or cardboard material, said package having a top side, said teat unit comprising: an upwardly extending teat part, an intermediate radial flange and a downwardly extending insertion part, said insertion part comprising holding means adapted for holding the teat unit in position during dispensing with said radial flange having a downwardly facing side in engagement with said top side of said package, said insertion part including means for puncturing said top side of said package and being insertable through said top side of said package through an exposed opening in said top side of said package wherein said radial flange is shaped as a cover plate having substantially the same extent as the area of said top side of said package for the package size with which the teat unit is to be used, and said holding means are adapted to hold said cover plate to bear against said top side of said package and to hold said top side of said package in direct sealing engagement with said downwardly facing side of said cover plate.

2. A teat unit according to claim 1, wherein said holding means comprise an annular groove provided directly below said downwardly facing side of said cover plate to receive the package material in said opening.

3. A teat unit according to claim 2, wherein said holding means comprise exterior threads on said insertion part, said threads terminating in said annular groove.

4. A teat unit according to claim 3, wherein said threads are constructed and arranged to expand conically in an upward direction toward said groove.

5. A teat unit according to claim 1, wherein said cover plate comprises parts which protrude beyond said opening defined in said top side of said package.

6. A combination disposable package and teat unit as recited in claim 1, wherein said package comprises an external section having a temperature-sensitive coating which is adapted to change color when subjected to increasing temperature, and said opening is predefined in said topside of said package and sealed by a fracturable seal, wherein insertion of said teat unit punctures said fracturable seal.

* * * * *

UNITED STATES PATENT AND TRADEMARK OFFICE

CERTIFICATE OF CORRECTION

PATENT NO. : 5,860,540
DATED : January 19, 1999
INVENTOR(S) : Steen Bock

It is certified that error appears in the above-identified patent and that said Letters Patent is hereby corrected as shown below:

On the title page, item [73] Assignee, change the city of residence "Kogestate" to read --Koge--.

Signed and Sealed this

Twentieth Day of July, 1999

*Attest:*

Q. TODD DICKINSON

*Attesting Officer*

*Acting Commissioner of Patents and Trademarks*